US009212448B2

(12) United States Patent
Hering et al.

(10) Patent No.: US 9,212,448 B2
(45) Date of Patent: Dec. 15, 2015

(54) HOUSEHOLD APPLIANCE, IN PARTICULAR A HOUSEHOLD DISHWASHING MACHINE

(75) Inventors: Reinhard Hering, Holzheim (DE); Michael Georg Rosenbauer, Reimlingen (DE)

(73) Assignee: BSH Hausgeraete GmbH, Munich (DE)

( * ) Notice: Subject to any disclaimer, the term of this patent is extended or adjusted under 35 U.S.C. 154(b) by 606 days.

(21) Appl. No.: 13/498,588

(22) PCT Filed: Sep. 27, 2010

(86) PCT No.: PCT/EP2010/064205

§ 371 (c)(1),
(2), (4) Date: Mar. 28, 2012

(87) PCT Pub. No.: WO2011/045169

PCT Pub. Date: Apr. 21, 2011

(65) Prior Publication Data

US 2012/0180830 A1 Jul. 19, 2012

(30) Foreign Application Priority Data

Oct. 12, 2009 (DE) ..... 10 2009 045 591

(51) Int. Cl.

| | |
|---|---|
| ***D06F 39/00*** | (2006.01) |
| ***A47L 15/00*** | (2006.01) |
| ***A47L 15/42*** | (2006.01) |

(Continued)

(52) U.S. Cl.

CPC ..... *D06F 39/005* (2013.01); *A47L 15/0047* (2013.01); *A47L 15/4293* (2013.01); *A47L 15/46* (2013.01); *D06F 33/02* (2013.01); *A47L 2401/20* (2013.01); *A47L 2501/26* (2013.01); *A47L 2501/32* (2013.01); *D06F 2216/00* (2013.01)

(58) Field of Classification Search

CPC ... D06F 39/005; D06F 2216/00; D06F 33/02; A47L 15/4293; F24C 7/082

USPC ..... 134/57 D, 58 D, 18, 113, 25.2, 56 D, 134/56 R; 219/492, 506, 494, 412, 720, 489, 219/497, 508; 68/12.01, 12.27, 12.16, 3 R, 68/12.02, 12.23, 13 R

See application file for complete search history.

(56) References Cited

U.S. PATENT DOCUMENTS

| | | | | |
|---|---|---|---|---|
| 9,004,081 | B2 * | 4/2015 | Hering et al. | 134/113 |
| 2004/0070574 | A1 * | 4/2004 | Wylie et al. | 345/184 |

(Continued)

FOREIGN PATENT DOCUMENTS

| | | | |
|---|---|---|---|
| DE | 4343105 | A1 | 6/1995 |
| DE | 19624890 | A1 | 8/1997 |

(Continued)

OTHER PUBLICATIONS

International Search Report PCT/EP2010/064205.

*Primary Examiner* — Michael Barr
*Assistant Examiner* — Thomas Bucci
(74) *Attorney, Agent, or Firm* — James E. Howard; Andres Pallapies

(57) ABSTRACT

A household appliance, in particular a household dishwasher, includes an operating display unit having at least one visual display, and a power supply network for supply of electrical energy. The household appliance is isolated from the power supply network after completion of a treatment cycle, and the visual display is configured to display at least the completion of the completed treatment cycle as a first operating state.

23 Claims, 4 Drawing Sheets

(51) Int. Cl.
*A47L 15/46* (2006.01)
*D06F 33/02* (2006.01)

(56) References Cited

U.S. PATENT DOCUMENTS

2006/0017534 A1* 1/2006 Accoto et al. ..... 335/78
2007/0193311 A1* 8/2007 No et al. ..... 68/140
2010/0139722 A1* 6/2010 Koch et al. ..... 134/57 D
2010/0251776 A1 10/2010 Bischoff et al.
2010/0262315 A1* 10/2010 Rosenbauer ..... 700/296
2011/0115306 A1* 5/2011 Rosenbauer ..... 307/116

FOREIGN PATENT DOCUMENTS

WO WO 2009071411 A1 * 6/2009
WO WO 2010010146 A1 * 1/2010

* cited by examiner

HOUSEHOLD APPLIANCE, IN PARTICULAR A HOUSEHOLD DISHWASHING MACHINE

BACKGROUND OF THE INVENTION

The invention relates to a household appliance, in particular a household dishwasher, at least having an operating display with at least one visual display means.

When consumer organizations rate household appliances, the energy consumption of the household appliance, in particular also its annual energy balance sheet, plays a significant role. Household appliances have an operating display with at least visual display means, for example LEDs, which can be used during the operation of the household appliance to display operating parameters, etc. and after completion of a treatment cycle according to a program to indicate that the treatment cycle has been completed. However after the end of the program the household appliance remains connected to the power supply network until the customer actively intervenes and deactivates the household appliance by actuating the main switch.

BRIEF SUMMARY OF THE INVENTION

The object of the invention is to provide a household appliance, in particular a household dishwasher, with which energy consumption is further reduced.

According to the invention after completion of a treatment cycle the household appliance is isolated from a power supply network supplying said household appliance with electrical energy and the visual display means are configured to display at least the completion of the completed treatment cycle after isolation from the supply network. In this process the household appliance is completely isolated from the power supply network so that no standby losses occur, for example by means of a self-deactivation device, which has a self-holding contact circuit, which brings about automatic isolation of the household appliance from the power supply network after completion of a treatment program or a wash program of a dishwasher without operator intervention. This means that no energy has to be expended to display this operating state. The information about the operating state conveyed by the display means can therefore be maintained without energy being supplied from the power supply network.

This can be achieved with various embodiments. According to one variant the display means can have an electronic paper, which can display text and/or images permanently without a power supply, in other words a conservation voltage. The display can be changed at a later time by supplying power. Alternatively the display means can have mechanical displays or information holders, for example boards, which pivot immediately before an operating state comes into being and thus display the operating state. Alternatively the display means can have a memory metal element, which when current is flowing through take up a first position and in the power-free state take up a second position, thereby actuating mechanical display means.

As an alternative to the above embodiments the display means can be fed by means of a capacitor in a state that is independent of the power supply network. The display means themselves can be configured here in an energy-saving manner as what are known as low-power LEDs or transflective LCDs.

In one preferred embodiment the visual display means can indicate the completion of the treatment cycle, i.e. a wash cycle, or operation readiness of the household appliance in the energy-free state. This embodiment is based on tests, which show that the time period between completion of the actual treatment cycle and a following treatment cycle can be in the region of hours or days. If in the case of commercially available household appliances the main switch is not deactivated after the end of the treatment cycle, the visual display means in particular, which indicate the end of the program, then remain activated until the following treatment cycle. The energy consumption of the household appliance can thus be tangibly increased in the annual energy balance sheet. With the inventive feature in contrast the energy consumption resulting from the program end display is reduced to 0, so the above-mentioned overall energy consumption is correspondingly reduced in the annual energy balance sheet.

As already mentioned above, the display means can have a mechanically displaceable information holder, which can be displaced to display different operating states. The information holder can be made to overlap partially with a display viewing window of the display means. When the information holder is mechanically displaced, different display segments of the information holder can be made to overlap with the display viewing window, with the result that the different operating states can be displayed.

The information holder can be displaced between the two operating states by means of an in particular electrical actuator.

In one energy-saving embodiment a voltage pulse can simply be applied to the actuator to switch from a display of the first operating state to a display of the second operating state, the actuator being otherwise energy-free. In a further variant energy can be applied permanently to the actuator to display the first operating state, for example the abovementioned treatment cycle. The actuator then only switches automatically to the second operating state when it is in an energy-free state.

The actuator can be configured for example as an electromagnetic, linearly displaceable control element having a working rod, which is fastened to a magnet armature and can be displaced linearly by means of an electromagnetic coil.

Alternatively the actuator can have a memory metal element, which, when current is passed through it, moves the information holder to a first position to display the first operating state to a position to display the second operating state.

Alternatively the actuator can be embodied as a bistable actuator, which, when no current is passed through it, takes up at least a first position to display the first operating state or a second position to display the second operating state. The bistable actuator can be switched by means of electrical actuation from the first to the second position and vice versa. Electrical actuation can be produced by means of a voltage pulse.

Provision is also preferably made for the on switch and an off switch to be connected in a parallel manner. The power supply network can be in contact for example with an on switch configured as a microswitch and the switching element connected parallel to this. When the household appliance is out of operation, both the on switch and the switching element are open. Actuation by pressing of the microswitch allows the deactivated, i.e. open, switching element of the self-holding contact circuit to be bridged, with the result that a voltage pulse is applied to the control device. The voltage pulse is directed by way of the control device to the self-holding contact circuit, with the result that the self-holding contact circuit closes the switching element. This allows current from the network to flow by way of the now closed switching element to the self-holding contact circuit so that the switching element remains closed in a stable manner, while the on switch is opened again. As soon as the control device directs the deactivation signal to the self-holding contact circuit, said circuit opens the switching element, causing the power supply into the household appliance to be interrupted.

Provision is preferably made here for an equally high electrical voltage to be present at the on switch and the off switch. This allows a particularly simple structure.

Provision is preferably made here for the on switch and the off switch to be connected to the control device in such a manner that an activation and/or deactivation pulse is transmitted. Provision is preferably also made for the power supply unit to be disposed in such a manner that it forms a series circuit with the on switch and the off switch. Provision is also preferably made for the control device to be connected to the power supply unit in such a manner that it can be supplied with electrical energy. Provision is furthermore preferably made for the operating display to be connected to the power supply unit in such a manner that it can be provided with electrical energy. Finally provision is preferably made for the self-holding contact circuit to be assigned to a controller that can be actuated by the control device.

The self-holding contact circuit can preferably have a bistable relay, to which a relay contact acting as a switching element can be connected. Such a bistable relay is primarily characterized by the attribute that in the power-free state it can adopt two different stable switching states. A relay contact of the bistable relay can also be connected as a switching element in the main supply line of the household appliance. When the deactivation signal is applied to the bistable relay, it switches the relay contact from a stable power-free open state to a stable power-free closed state or vice versa, with the result that the household appliance is decoupled completely from the network or connected to it. A flipflop, in particular an RS flipflop, can be used instead of a relay.

Provision is also preferably made for the self-holding contact circuit to be connected to the off switch in such a manner that the off switch can be switched to an open state so that isolation from the supply voltage is possible in a simple manner.

In one preferred embodiment provision is made for it to be possible for the display means to be supplied with electrical energy from an energy storage unit of the household appliance after isolation from the power supply network. Thus a display means is used which consumes electrical energy when used. For example components demonstrating very low energy consumption can be used, for example low power LEDs or transflective LCDs, to ensure an adequate operating time.

Provision is preferably made here for it to be possible to recharge the energy storage unit with electrical energy when the household appliance is connected to the power supply network. This is the case for example when the household appliance is taken into operation again, so that an adequate operating time is always ensured.

The energy storage unit can be for example an accumulator, which is assigned to the display means, in other words only supplies this with electrical energy when the household appliance is isolated from the power supply network. Provision is preferably made for the energy storage unit to be a capacitor of an electrical drive unit of the household appliance, in particular a pump motor. It is thus not necessary to provide an additional accumulator but for example a capacitor of an electronic motor unit actuating the pump motor, which serves as an intermediate circuit capacitor, can be used.

BRIEF DESCRIPTION OF THE DRAWINGS

Two exemplary embodiments of the invention are described in more detail below with reference to the accompanying figures, in which.

DETAILED DESCRIPTION OF EXEMPLARY EMBODIMENTS OF THE PRESENT INVENTION

Figure 1:
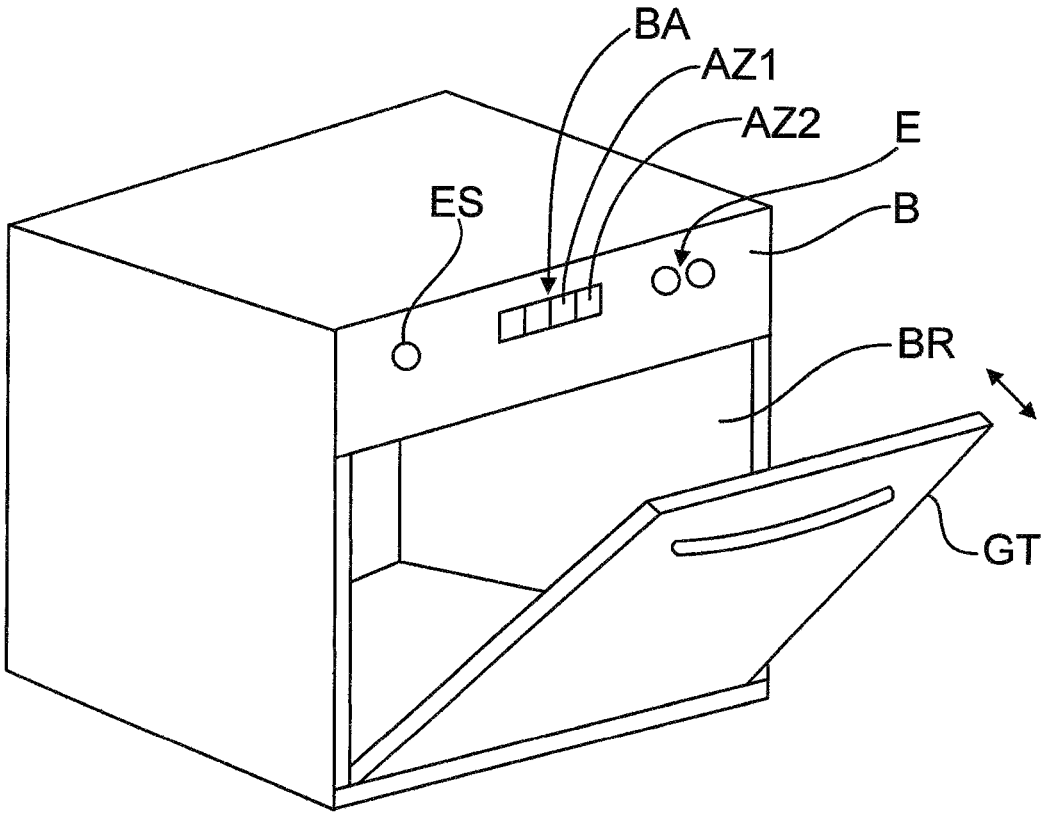
FIG. 1 shows a schematic perspective view of a household dishwasher.

FIG. 1 shows an exemplary embodiment of a household appliance in the form of a household dishwasher with a front appliance door GT, which can be pivoted in the known manner about a horizontal pivot axis at the bottom and with which a loading opening of the wash compartment BR can be opened for loading and/or unloading or closed. The loading opening is bounded at the top by a control panel B, which holds a microswitch ES and a (simply indicated) operating display BA having visual display means AZ1 and visual display means AZ2. The visual display means AZ1 indicate operating parameters for example. In contrast the visual display means AZ2 indicate operation during the course of the wash program run and the program end after the end of the wash program.

Input means E are also provided, which can be used to input operating parameters for a wash cycle of the household dishwasher.

The microswitch ES provided in the left region of the control panel B in FIG. 1 is configured here as a pushbutton switch for example. Actuation by pressing of the microswitch ES allows the household dishwasher to be connected to the power supply network so that it is switched to operation readiness, while subsequent actuation by pressing of the microswitch ES decouples the household dishwasher from the power supply network.

Figure 2:
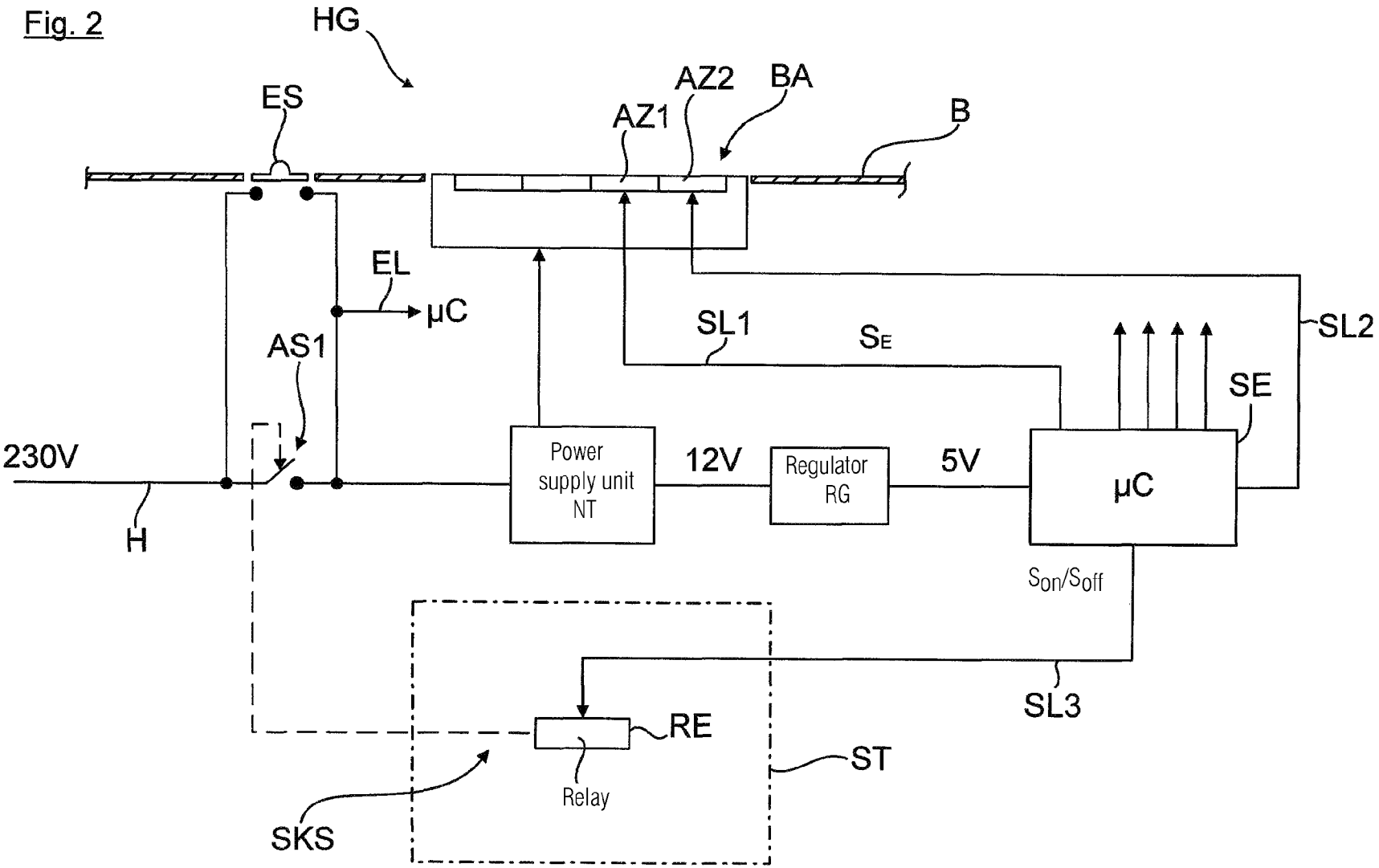
FIG. 2 shows a circuit arrangement of the household dishwasher.

FIG. 2 shows a circuit arrangement, in which the microswitch ES and the operating display BA by way of example are integrated. In the circuit arrangement shown the household dishwasher is connected by way of a main supply line H to the power supply network. Connected in series in the main supply line H are a switching element AS (described below) and a power supply unit NT.

The power supply unit NT converts the network voltage of for example 230 V to a low voltage of 12 V. The low voltage 12V is converted by means of a regulator RG connected in series downstream of the power supply unit NT to a low voltage of 5 V, which is supplied to a control device SE. The power supply unit NT also supplies other appliance components and the visual display means AZ1 and AZ2 of the operating display BA of the household dishwasher with low voltage by way of additional outputs.

The control device SE is integrated in a control module (not shown in detail) and during the execution of a wash program actuates the visual display means AZ1 of the operating display BA by way of a first signal line SL1 and the visual display means AZ2 and further appliance components, for example the drain pump or the circulating pump, by way of a second signal line SL2 by means of control signals $S_E$.

The control device SE also controls the display means AZ2 of the operating display BA by way of the second signal line SL2, to indicate the end of the program of the household dishwasher.

Figure 3:
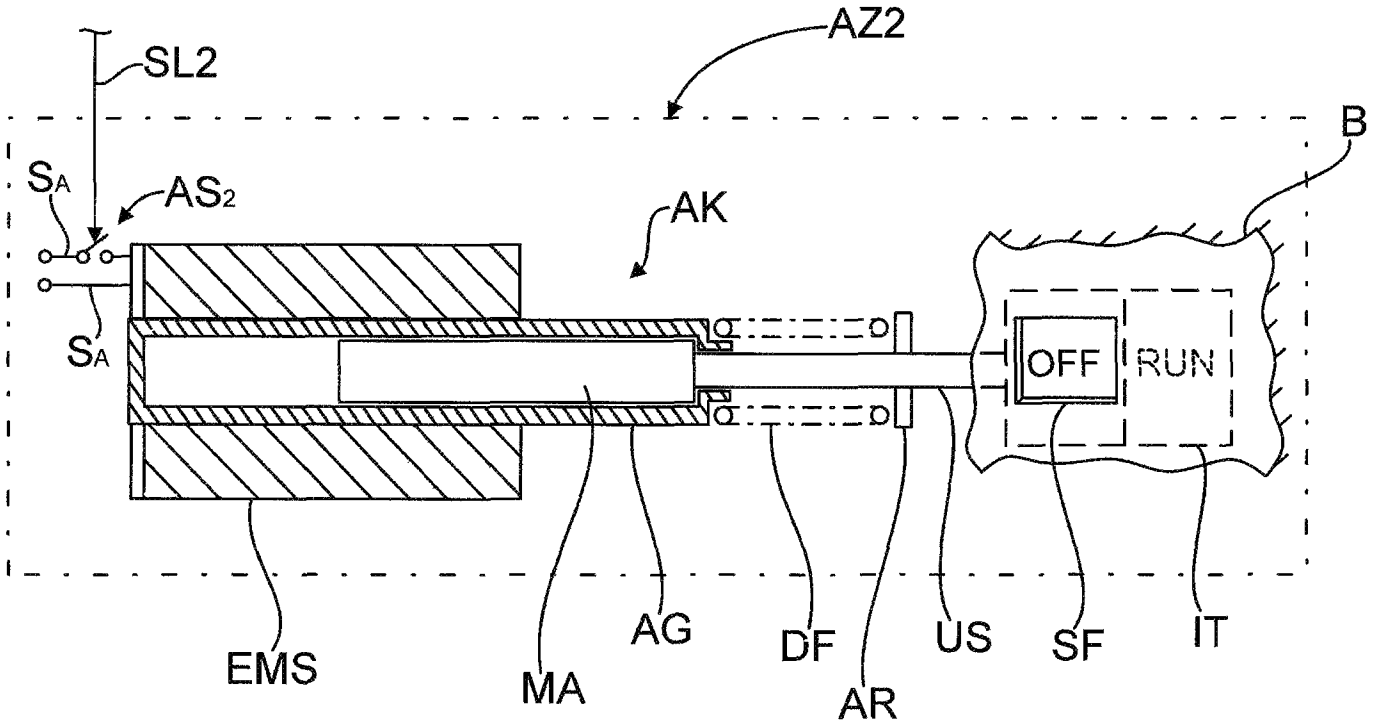
FIG. 3 shows the visual display means with associated actuator according to the first exemplary embodiment.

The display means AZ2 is shown in more detail in a first exemplary embodiment in FIG. 3. According to this the display means AZ2 has a viewing window SF cut out of the front panel B of the household dishwasher. Disposed behind the viewing window SF is a plate-type information holder IT, which can be displaced behind it. It has two display segments "OFF" and "RUN". Depending on the operating state the display segment "OFF" or the display segment "RUN" can be made to overlap with the viewing window SF, thereby indicating the current operating state of the household dishwasher.

As also shown in FIG. 3 the information holder IT is connected to a transmission rod US of an actuator AK configured as an electromagnetic control element. The transmission rod US is fastened to a magnet armature MA, which passes in a linearly displaceable manner inside a sleeve-type armature housing AG. Stretched between the end face of the armature housing AG and a stop ring AR of the transmission rod US is a compression spring DF, which in FIG. 3 pushes the transmission rod US to the right together with the information holder IT.

An electromagnetic coil EMS is positioned on the outer circumference of the armature housing AG. It is supplied by the power supply unit NT with a low voltage of 12V by way of connecting lines $S_A$. Connected in the upper connecting line $S_A$ in FIG. 3 is a switch AS2, shown in its open position in FIG. 3. The switch AS2 can in turn be controlled between its open and closed positions by the control device SE by way of the signal line SL2.

In the open position of the off switch AS2 shown in FIG. 3 the electromagnetic coil EMS is power-free and the transmission rod US therefore moves to the right.

As also shown in FIG. 2, the control device SE is connected by way of a third signal line SL3 to a bistable relay RE of a self-holding contact circuit SKS. The above-mentioned switching element AS, which is connected in the main supply line H instead of a mechanical main switch, is assigned to the bistable relay RE as a relay contact. The switching element AS1 therefore takes on a main switch function, which can be used to decouple the household dishwasher from the power supply network or connect it to it.

When the household dishwasher is out of operation both the microswitch ES and the switching element AS1 are open, so that a power supply to the household dishwasher is interrupted. The deactivated household dishwasher is brought into operation by actuation by pressing of the microswitch ES into its closed position, causing the initially still open switching element AS to be bridged. The actuation by pressing of the microswitch ES causes a voltage pulse to be supplied, which is directed by way of the power supply unit NT and by way of the regulator RG to the control device SE.

The control device SE then forwards an activation signal $S_{on}$, to the bistable relay RE causing its relay coil to attract and the switching element AS1 to be switched from the power-free stable open state to an equally power-free stable closed state. This causes the microswitch ES, which after actuation by pressing is again open, to be bridged by the now closed switching element AS, with the result that the network voltage is present at the power supply unit NT.

The household dishwasher is therefore switched to operation readiness so that a wash program can then be started by means of the input means E. During the wash cycle the visual display means AZ1 display the respectively set operating parameters. Also during the wash cycle a control signal generated by the control device SE is applied to the visual display means AZ2 by way of the signal line SL2.

This applied control signal moves the off switch AS2 in the upper connecting line $S_A$ of the actuator AK according to FIG. 3 to its closed position during the wash program. Current therefore flows through the electromagnetic coil EMS of the actuator AK during the entire wash cycle, so that the magnet armature MA with its transmission rod US is drawn magnetically to the left by the electromagnetic coil EMS in FIG. 2. The display segment "RUN" of the information holder IT then overlaps with the display viewing window SF, so that the ongoing wash cycle is displayed as such by the visual display means AZ2.

After the end of the wash cycle, the control device SE deactivates the appliance components, for example the drain pump or circulating pump. Immediately after completion of the wash program the control device SE also generates a voltage pulse, which as a deactivation signal $S_{off}$ by way of the third signal line SL3 actuates the bistable relay RE. The relay RE then switches the switching element AS1 from the power-free stable closed position to the power-free stable open position, with the result that the household dishwasher is completely isolated from the power supply network.

Therefore after completion of the wash program no electrical energy is consumed to display the end of the program.

Once the household dishwasher has been completely deactivated, the power supply to the actuator AK of the visual display means AZ2 is also interrupted so that the spring-tensioned transmission rod US of the magnet armature MA is pushed by the spring force of the compression spring DF into its original position, in which the display segment "OFF" of the information holder IT overlaps with the viewing window SF, so that the program end of the wash cycle of the household dishwasher is displayed in a power-free manner.

As also shown in FIG. 2, the microswitch ES is connected directly to the control device SE for signal transmission purposes by way of an input line EL. The voltage pulse supplied when the microswitch ES is actuated manually by pressing is therefore directed directly to the control device SE, which detects and analyzes the pulse.

On detection of such a voltage pulse the control device SE checks whether the power supply unit NT is already activated when the microswitch ES is activated by pressing. If the power supply unit NT is not yet activated, the control device SE identifies activation actuation by the user and uses the activation signal $S_{on}$, as described above, to actuate the relay RE. If the power supply unit NT is already activated, the control device SE identifies a deactivation actuation by the user from the actuation by pressing of the microswitch, so the control device SE directs a corresponding deactivation signal $S_{off}$ to the relay RE. The household dishwasher is then taken out of operation. Any ongoing wash program is therefore interrupted.

Figure 4:
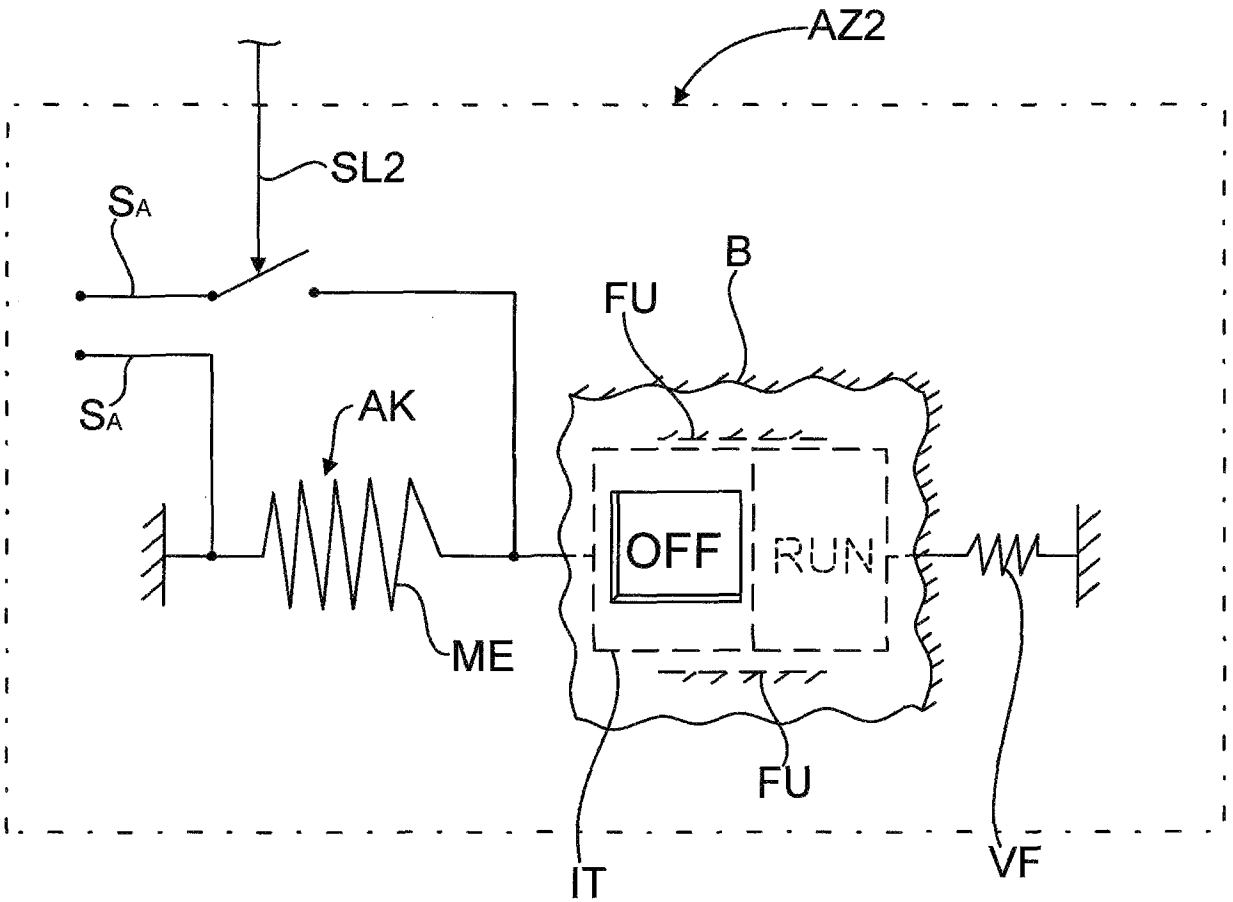
FIG. 4 shows the visual display means with associated actuator according to the second exemplary embodiment.

FIG. 4 shows the actuator AK of the visual display means AZ2 according to a second exemplary embodiment. As in the first exemplary embodiment in FIG. 3, when current is flowing through it the display means AZ2 in FIG. 4 indicates ongoing operation during the execution of the wash program. In the power-free state the visual display means AZ2 indicates the end of the program.

The actuator AK shown in FIG. 4 has a memory metal element ME configured in the manner of an accordion, its ends making contact with the electrical connecting lines $S_A$, the upper connecting line of which is interrupted by the off switch AS2 in FIG. 4.

The memory metal element ME is supported in a fixed position by its left end in FIG. 4. The memory metal element ME is connected by its right end to the information holder IT. This in turn is pretensioned to the right by the pretensioning spring VF, so that in the power-free state the display segment "OFF" of the information holder IT appears in the viewing window SF. The information holder is supported in such a manner that it can be moved between the indicated upper and lower guides FU.

As in the first exemplary embodiment the off switch AS2 is connected for signal transmission purposes SL2 to the control device SE. During the wash cycle this controls the off switch AS2 into its closed position. The memory metal element ME, which then has current flowing through it, retracts as a result counter to the spring force of the pretensioning spring VF, with the result that the display segment "RUN" appears in the viewing window SF, indicating that the wash program is running.

After the end of the program, as described with reference to FIG. 2, the household dishwasher is completely isolated from the power supply network. After deactivation of the household dishwasher the memory metal element ME is therefore switched to power-free, with the result that it extends back again into its original position as shown in FIG. 4, in which the display segment "OFF" of the information holder IT appears in the viewing window SF.

LIST OF REFERENCE CHARACTERS

ES Microswitch
AS1, AS2 Switching elements
H Main supply line
B Control panel
AZ1, AZ2 Display means
BA Operating display
EL Input line
RG Regulator
SE Control device
RE Bistable relay
SKS Self-holding contact circuit
ST Controller
HG Household appliance
SL1, SL2, SL3 Signal lines
BR Treatment compartment
EMS Electromagnetic coil
AK Actuator
MA Magnet armature
US Transmission rod
ME Memory metal element
DF Compression spring
VF Pretensioning spring
$S_A$ Connecting lines
FU Guides

The invention claimed is:

1. A household appliance, comprising:

an operating display unit having at least one visual display;

a self-deactivation device configured to isolate the household appliance from a power supply network external to the household appliance;

wherein the self-deactivation device is configured to isolate the household appliance from the power supply network after completion of a treatment cycle without intervention by an operator of the household appliance; and the at least one visual display is configured to actuate a display to communicate at least the completion of the completed treatment cycle as a first operating state after the household appliance has been isolated from the power supply network by the self-deactivation device.

2. The household appliance of claim 1, constructed in the form of a household dishwasher.

3. The household appliance of claim 1, wherein the operating display is configured to display an ongoing treatment cycle as a second operating state, when the household appliance is connected to the power supply network.

4. The household appliance of claim 1, wherein the operating display includes a mechanically displaceable information holder, which is displaceable to display the first operating state or a second operating state of the household appliance.

5. The household appliance of claim 4, wherein the operating display includes at least one display viewing window, positioned to at least partially overlap with the information holder.

6. The household appliance of claim 4, further comprising an actuator to displace the information holder between the first and second operating states.

7. The household appliance of claim 6, wherein the actuator is an electrical actuator.

8. The household appliance of claim 6, wherein the actuator is configured to receive a voltage pulse for switching from a display of the second operating state to a display of the first operating state.

9. The household appliance of claim 6, wherein the actuator is permanently supplied with energy to display the second operating state.

10. The household appliance of claim 4, wherein the second operating state is a RUN operating state to indicate running of the treatment cycle.

11. The household appliance of claim 4, wherein the first operating state is an OFF operating state of the household appliance.

12. The household appliance of claim 6, wherein the actuator is an electromagnetic displaceable control element.

13. The household appliance of claim 6, wherein the actuator has a memory metal element, which, when current is passed through it, moves the information holder to a position to display the second operating state and, when no current is passed through it, to a position to display the first operating state.

14. The household appliance of claim 6, wherein the actuator is a bistable actuator which, when no current is passed through it, takes up a first position to display the second operating state or a second position to display the first operating state.

15. The household appliance of claim 14, wherein the bistable actuator is switchable by electrical actuation from the first position to the second position and vice versa.

16. The household appliance of claim 1, wherein the operating display includes an electronic paper, which after a current has been applied, permanently indicates the first operating state or a second operating state without a power supply.

17. The household appliance of claim 1, further comprising an energy storage unit to supply the operating display with electrical energy after isolation from the power supply network.

18. The household appliance of claim 17, wherein the energy storage unit is configured for recharging with electrical energy when the household appliance is connected to the power supply network.

19. The household appliance of claim 17, further comprising an electrical drive unit the energy storage unit is a capacitor of an electrical drive unit of the household appliance.

20. The household appliance of claim 19, wherein the drive unit is a pump motor.

21. The household appliance of claim 1, wherein the entire household appliance is isolated from the power supply network after completion of a treatment cycle.

22. The household appliance of claim 1, wherein the visual display is configured to display at least the completion of the completed treatment cycle as a first operating state after being isolated from the power supply network.

23. The household appliance of claim 1, wherein the self-deactivation device comprises a self-holding contact circuit.

* * * * *